US009890002B2

(12) United States Patent
Capoia

(10) Patent No.: US 9,890,002 B2
(45) Date of Patent: Feb. 13, 2018

(54) PLANT AND METHOD FOR MAKING PACKAGES

(71) Applicant: PANOTEC S.R.L., Cimadolmo (IT)

(72) Inventor: Giuseppe Capoia, Cimadolmo (IT)

( * ) Notice: Subject to any disclaimer, the term of this patent is extended or adjusted under 35 U.S.C. 154(b) by 0 days.

(21) Appl. No.: 15/314,443

(22) PCT Filed: Jun. 19, 2015

(86) PCT No.: PCT/IB2015/054636

§ 371 (c)(1),
(2) Date: Nov. 28, 2016

(87) PCT Pub. No.: WO2015/198198

PCT Pub. Date: Dec. 30, 2015

(65) Prior Publication Data

US 2017/0096245 A1 Apr. 6, 2017

(30) Foreign Application Priority Data

Jun. 25, 2014 (IT) ..... UD2014A0108

(51) Int. Cl.

| | |
|---|---|
| ***B65H 3/44*** | (2006.01) |
| ***B65H 5/26*** | (2006.01) |
| ***B65B 41/02*** | (2006.01) |
| ***B65B 59/00*** | (2006.01) |
| ***B65H 43/00*** | (2006.01) |
| ***B65B 35/54*** | (2006.01) |
| ***B65B 43/00*** | (2006.01) |
| ***B65B 65/00*** | (2006.01) |

(52) U.S. Cl.

CPC ..... *B65H 5/26* (2013.01); *B65B 35/54* (2013.01); *B65B 41/02* (2013.01); *B65B 43/00* (2013.01); *B65B 59/005* (2013.01); *B65B 65/006* (2013.01); *B65H 3/44* (2013.01); *B65H 43/00* (2013.01); *B65H 2407/21* (2013.01); *B65H 2701/175* (2013.01); *B65H 2701/176* (2013.01); *B65H 2801/81* (2013.01)

(58) Field of Classification Search

CPC . B65H 3/44; B65H 3/446; B65H 5/26; B65H 2407/21; B65H 2801/81; B65B 35/00; B65B 35/54; B65B 41/02; B65B 43/00; B65B 59/005; B65B 65/006

See application file for complete search history.

(56) References Cited

U.S. PATENT DOCUMENTS

2011/0164954 A1* 7/2011 Capoia ..... B65H 3/44
414/796.5

FOREIGN PATENT DOCUMENTS

WO 2010029418 3/2010

* cited by examiner

*Primary Examiner* — Prasad V Gokhale
(74) *Attorney, Agent, or Firm* — Themis Law

(57) ABSTRACT

A plant for making packages includes at least a machine to work packaging material and an automatic feed apparatus to feed the packaging material to the machine in a direction of automatic feed; a manual feeding and loading station of the packaging material, adjacent and parallel to the automatic feed apparatus, the machine being mobile in a direction of movement transverse to the direction of automatic feed and selectively positionable in a first position aligned to the automatic feed apparatus and in a second position aligned to the manual feeding and loading station; and a guide system to guide the machine between the first position and the second position and vice versa.

9 Claims, 5 Drawing Sheets

PLANT AND METHOD FOR MAKING PACKAGES

FIELD OF THE INVENTION

The present invention concerns a plant and a method for making packages in a relatively rigid packaging material, such as smooth or corrugated cardboard, plastic material or other materials with similar characteristics of rigidity suitable to be used as packaging materials.

In particular, the plant is preferentially though not restrictively applied for obtaining flat semi-worked products, shaped and possibly provided with creasings, semi-creasings, incisions, notches, punching or other similar or comparable workings. Each semi-worked product defines a substantially two-dimensional development of a package to be made, or at least a part of this. The packages are therefore obtainable starting from said semi-worked products, for example, by folding them along the predisposed creasings.

BACKGROUND OF THE INVENTION

In the packaging sector, it is known to obtain packages to contain products by folding flat semi-worked products made of a relatively rigid packaging material.

Among the packaging materials mainly used are cardboard, either smooth or corrugated, and plastic polymer materials such as for example polypropylene (PP) and polyethylene terephthalate (PET), but not excluding other materials with comparable characteristics of rigidity. Hereafter in the present description reference will be made to the combination of said materials using the generic term packaging materials.

It is known to make packages using plants comprising a machine for working packaging material provided with one or more operating stations configured to perform a plurality of workings, for example cutting and/or creasing, on said packaging materials.

From the application WO-A-2010/029418 in the name of the present Applicant plants are also known for making packages that also include an apparatus to feed the packaging material to the machine, which apparatus comprises a storage and feed unit, in which the packaging material to be worked is disposed, and removal and transport means to move the packaging material from the storage unit to the machine in which it is worked.

The storage and feed unit can include one or more storage sectors of the packaging material, following each other in a direction of feed of the material and configured to contain one or more pallets, possibly adjacent, of sheets, strips or reels of the packaging material, also of different sizes.

Each sector is served by corresponding removal and transport means, for the automatic feed of the packaging material to the working machine according to a feed line or more frequently, according to a plurality of overlapping feed lines.

Normally, in the plants thus made, the machine includes a loading device or selector, which receives the packaging material from the feed apparatus and conveys it toward a device to introduce the packaging material into the one or more work stations.

Though able to supply high productivity, known plants to make packages could have some limitations in terms of flexibility, in particular in the variety of conformation of the packaging materials that can be used. These limitations can be due, for example, to both the constraint defined by the sizes of the sectors of the storage and feed unit and to the configuration of the removal and transport means, and to the fact that said plants are applied with economic advantage only in continuous functioning or in the execution of large sized batches.

The execution, in known plants, of small production batches, heterogeneous, and/or with great diversity between the packaging materials needed, is at least disadvantageous, if not actually impossible, both for reasons concerning the times needed to prepare and modify the operating conditions, and also for reasons of design constancy.

There is therefore a need to perfect a plant and a corresponding method to make packages, which can overcome at least one of the disadvantages of the state of the art.

In particular, one purpose of the present invention is to obtain a plant to make packages which is flexible and can be used for the production of a wide range of products for which a great variety of sizes of packaging materials is needed, and which at the same time allows to carry out in an economically advantageous way production batches of both large sizes and small entity and heterogeneous.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purpose, a plant to make packages according to the present invention comprises at least a machine for working packaging material and an automatic feed apparatus to feed the packaging material to the machine in a direction of automatic feed.

According to a characteristic aspect of the present invention, the plant comprises a manual feeding and loading station of the packaging material, adjacent and parallel to the automatic feed apparatus. Moreover, the machine for working the packaging material is mobile in a direction of movement transverse to the direction of automatic feed and is selectively positionable in a first position aligned to the automatic feed apparatus and in a second position aligned to the manual feeding and loading station. Moreover, guide means are provided to guide the machine between the first position and the second position and vice versa.

In this way the advantage is achieved of obtaining a flexible and complete plant, able to satisfy almost any production need, both in terms of dimensional varieties of the types of packaging material that can be fed to the working machine, and also in terms of quantitative varieties of the packages to be produced. Indeed, the plant according to the present invention lends itself both to the production in succession of considerable quantities of packages, for example according to continuous processes or in large size batches, and also to the production of small size heterogeneous batches, even needing packaging material of different bulk and possibly off-specification to the automatic feed apparatus.

Moreover, on the basis of the above, the present invention allows to obtain a plant which, as well as being versatile, is also advantageous economically, since it allows to use a manual load in all those difficult situations in which equipping the automatic loading apparatus would be too long and expensive.

According to one aspect of the present invention, the plant also comprises a loading device to load the packaging material interposed between said machine and the automatic feed apparatus and aligned to both. The loading device is mobile in the direction of automatic feed in order to assume a first loading condition in which it is connected to the working machine of the packaging material, and a second non-operative condition in which it is unconstrained and separate from the machine.

The fact that the loading device is mobile allows to free the working machine, when necessary, in order to allow it to move in the direction of movement.

The present invention also concerns a method to make packages using a plant for making packages, which provides to feed packaging material automatically in an automatic direction of feed, by means of an automatic feed apparatus, to a machine for working the packaging material.

According to the present invention, the method also provides to feed the packaging material manually to the machine by means of a manual feeding and loading station, which is adjacent and parallel to the automatic feed apparatus. Moreover, according to the invention, it is provided to move the machine in a direction of movement transverse with respect to the direction of automatic feed in order to selectively position it in a first position aligned to the automatic feed apparatus so as to feed the packaging material automatically, and in a second position aligned to the manual feeding and loading station to feed the packaging material manually.

In some forms of embodiment, feeding packaging material automatically first of all provides to prepare a loading device of the packaging material interposed between the working machine and the automatic feed apparatus, and aligned to both, and to connect the loading device to the machine in a first loading position. Moreover, before moving the machine from the first position to the second position, it provides to move the loading device in the direction of automatic feed, with respect to the loading condition, away from the machine, in order to make the loading device assume a second non-operative condition in which it is unconstrained and separate from the machine, which can therefore be moved.

BRIEF DESCRIPTION OF THE DRAWINGS

These and other characteristics of the present invention will become apparent from the following description of some forms of embodiment, given as a non-restrictive example with reference to the attached drawings wherein.

In the following description, the same reference numbers indicate identical parts of the plant for making packages according to the present invention, also in different forms of embodiment. It is understood that elements and characteristics of one form of embodiment can be conveniently incorporated into other forms of embodiment without further clarifications.

DETAILED DESCRIPTION OF FORMS OF EMBODIMENT

We shall now refer in detail to the various forms of embodiment of the present invention, of which one or more examples are shown in the attached drawing. Each example is supplied by way of illustration of the invention and shall not be understood as a limitation thereof. For example, the characteristics shown or described insomuch as they are part of one form of embodiment can be adopted on, or in association with, other forms of embodiment to produce another form of embodiment. It is understood that the present invention shall include all such modifications and variants.

Figure 1:
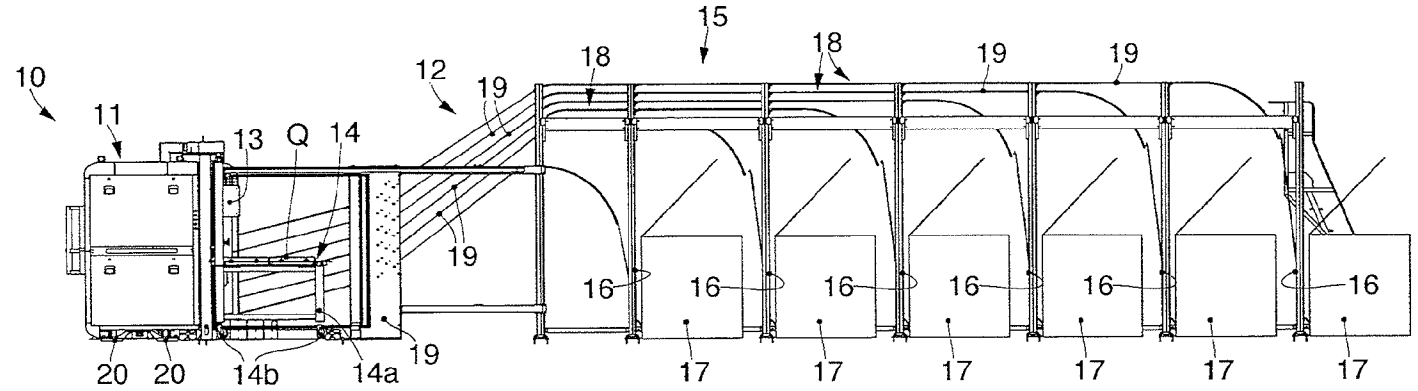
FIG. 1 is a plan view of forms of embodiment of a plant to make packages according to the present invention.
Figure 2:
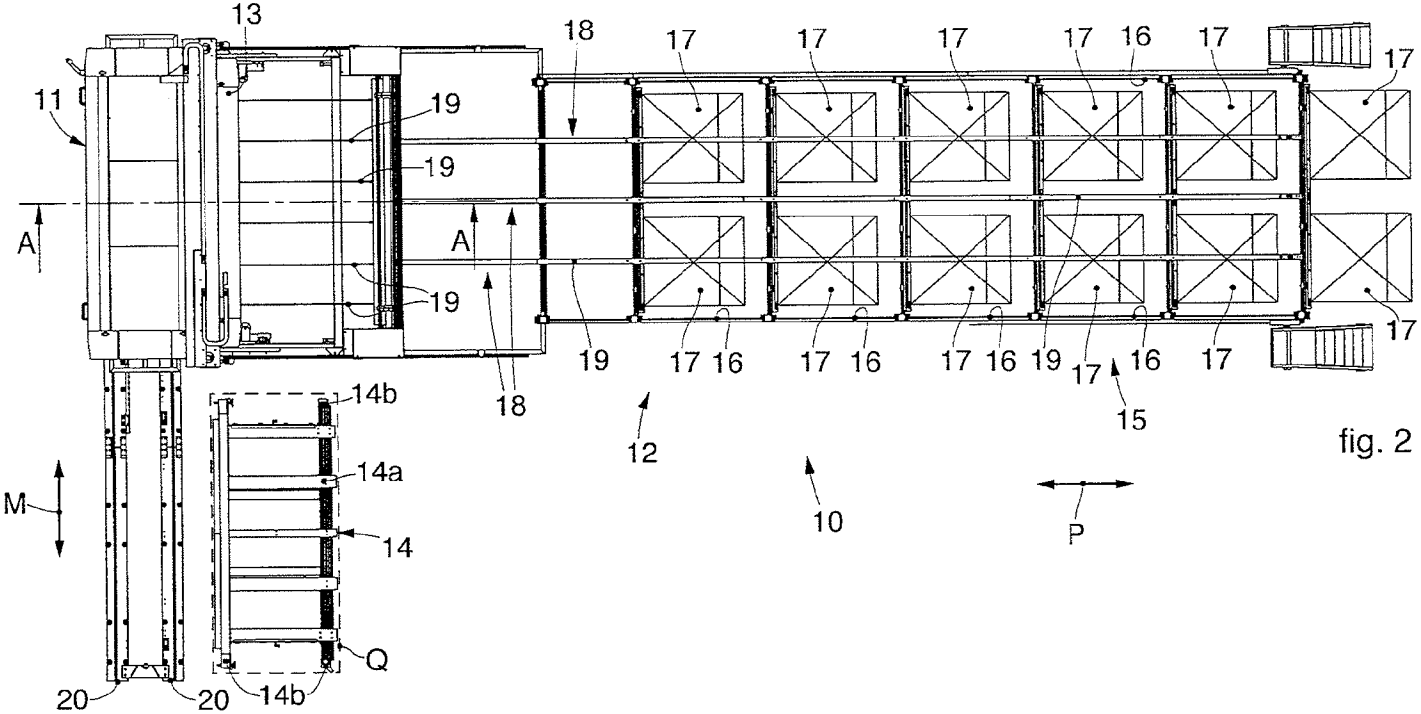
FIG. 2 is a lateral view of FIG. 1.

FIGS. 1 and 2 are used to describe forms of embodiment of a plant 10 for making packages, comprising a machine 11 for working packaging material, an automatic feed apparatus 12, and a manual feeding and loading station 14.

The automatic feed apparatus 12 is configured to feed the packaging material automatically, for example according to a process of continuous functioning, to the machine 11, making the material follow a travel in a direction of automatic feed P.

The machine 11 is configured to subject the packaging material to workings, such as for example cutting, incisions, and/or creasing for working flat semi-worked products, shaped and possibly creased, which are then folded and/or glued and/or assembled in another way in order to obtain the desired packages, for example of a box-like shape.

The automatic feed apparatus 12 can include a storage unit 15 of the packaging material, contained there in the form of sheets, strips or reels, even of different sizes.

In some forms of embodiment, the storage unit 15 can include a single, or in other possible implementations, a plurality of sectors 16, in each of which one or more pallets 17 of packaging material are positioned, possibly adjacent to each other to fill the space pertaining to each sector 16.

The automatic feed apparatus 12 also includes one or, as described by way of example with reference to the attached drawings, a plurality of removal and transport devices 18 to move the packaging material from the storage unit 15 to the machine 11.

Each removal and transport device 18 can be governed by a sector 16 of the storage unit 15 in order to remove the packaging material in the desired shape and size needed from the corresponding pallets 17, and to transport it to the working machine 11. In possible implementations, each removal and transport device 18 can include guide members 19 which allow to transfer the packaging material in a suitable guided manner, defining a feed path in the direction of automatic feed P.

With reference by way of example to FIG. 1, guide members 19 can be provided which define overlapping and vertically distanced feed paths, so as not to interfere with each other during the functioning of the plant 10.

The plant 10 described with reference by way of non-restrictive example to FIGS. 1, 3 and 4, can include a plurality of feed paths, six for example.

Simplified solutions, for example with five, four, three, two feed paths and even only one feed path, like solutions comprising more than six feed paths, for example seven, eight, nine or more than nine, can be equally provided in a plant 10 according to forms of embodiment in accordance with the present description.

In some forms of embodiment in accordance with the present description, the plant 10 can also comprise a loading device or selector 13. In possible implementations, the selector 13 is interposed between the automatic feed apparatus 12 and the machine 11, aligned to both, and has the function of loading into the machine 11 the packaging material coming from the automatic feed apparatus 12.

When the functioning of the plant 10 provides to feed the packaging material automatically to the machine 11, the selector 13 is connected to the machine 11 itself, in a loading condition.

The connection between the selector 13 and machine 11 can provide, for example, a removable mechanical attachment constraint, or the partial insertion of the selector 13 inside the machine 11 can be provided, so that it interferes with the transverse bulk of the latter. An example of a plant 10 that adopts the solution of partial insertion of the selector 13 into the machine 11 is described with reference to FIGS. 1, 2, 3 and 5 for example.

FIGS. 1 and 2 are used to describe forms of embodiment in which the manual feeding and loading station 14 is adjacent and parallel to the machine 11, for example laterally thereto with respect to the direction of automatic feed P.

By adjacent and parallel we mean that the automatic feed apparatus 12 and the manual feeding and loading station 14 can be used alternatively to feed the packaging material to the machine 11. It can mean that the parallel positioning implies that the manual feeding and loading station 14 defines a direction of manual feed that is parallel to the direction of automatic feed P.

In particular the first is used to feed the packaging material automatically, while the second is used to feed the material manually.

For this purpose, the machine 11 is configured mobile transversely with respect to the direction of automatic feed P, in a direction of movement M, in order to assume a first position aligned to the automatic feed apparatus 12, and a second position aligned to the manual feeding and loading station 14.

In preferential implementations, the direction of movement M is perpendicular with respect to the direction of automatic feed P.

In some forms of embodiment, the plant 10 can include guide means to guide the machine 11 between the first position and the second position, and vice versa. Transverse guides 20, rectilinear for example, are examples of possible guide means in accordance with forms of embodiment described here. In possible implementations, the transverse guides 20 can be positioned transversely with respect to the direction of automatic feed P and disposed in the direction of movement M.

The machine 11 can be mobile on the transverse guides 20 in order to position itself, when required, in the first and second position.

In possible solutions, the manual feeding and loading station 14 can define a support plane Q able to receive single sheets of packaging material that have to be fed manually to the machine 11. For example, the manual feeding and loading station 14 can include a support structure, or frame 14*a,* defining said support plane Q.

In possible implementations, the disposition of the support plane Q is such as to allow the manual feed of the sheets only by translating them in the direction of automatic feed P once positioned on the same support plane Q.

In some forms of embodiment, it can be provided that the manual feeding and loading station 14 is mobile at least in the direction of automatic feed P, for example to be moved toward the machine 11 after the latter has been placed in the second position cited above, and to be moved away from the machine 11 in order to facilitate the movement of the latter toward the first position.

Other solutions can provide a movement of the manual feeding and loading station 14 along two axes that are orthogonal to each other, for example disposed according to the directions of feed P and movement M.

Solutions can also be provided, shown by way of example in FIGS. 1, 2, 5, 6 and 7, in which the manual feeding and loading station 14 is freely mobile on its own lying plane, for example the floor of the building that contains the plant 10.

To allow this free movement of the manual feeding and loading station 14, the latter can include pirouetting wheels 14*b,* connected to its own frame 14*a* for example.

FIGS. 1 and 2 are also used to describe other forms of embodiment, which can be combined with all the forms of embodiment described here, in which the plant 10 can include longitudinal guides 21, rectilinear for example, positioned in the direction of automatic feed P and associated to the selector 13 for example.

The selector 13 is mobile in the direction of automatic feed P and can slide in this direction along the longitudinal guides 21.

Figure 3:
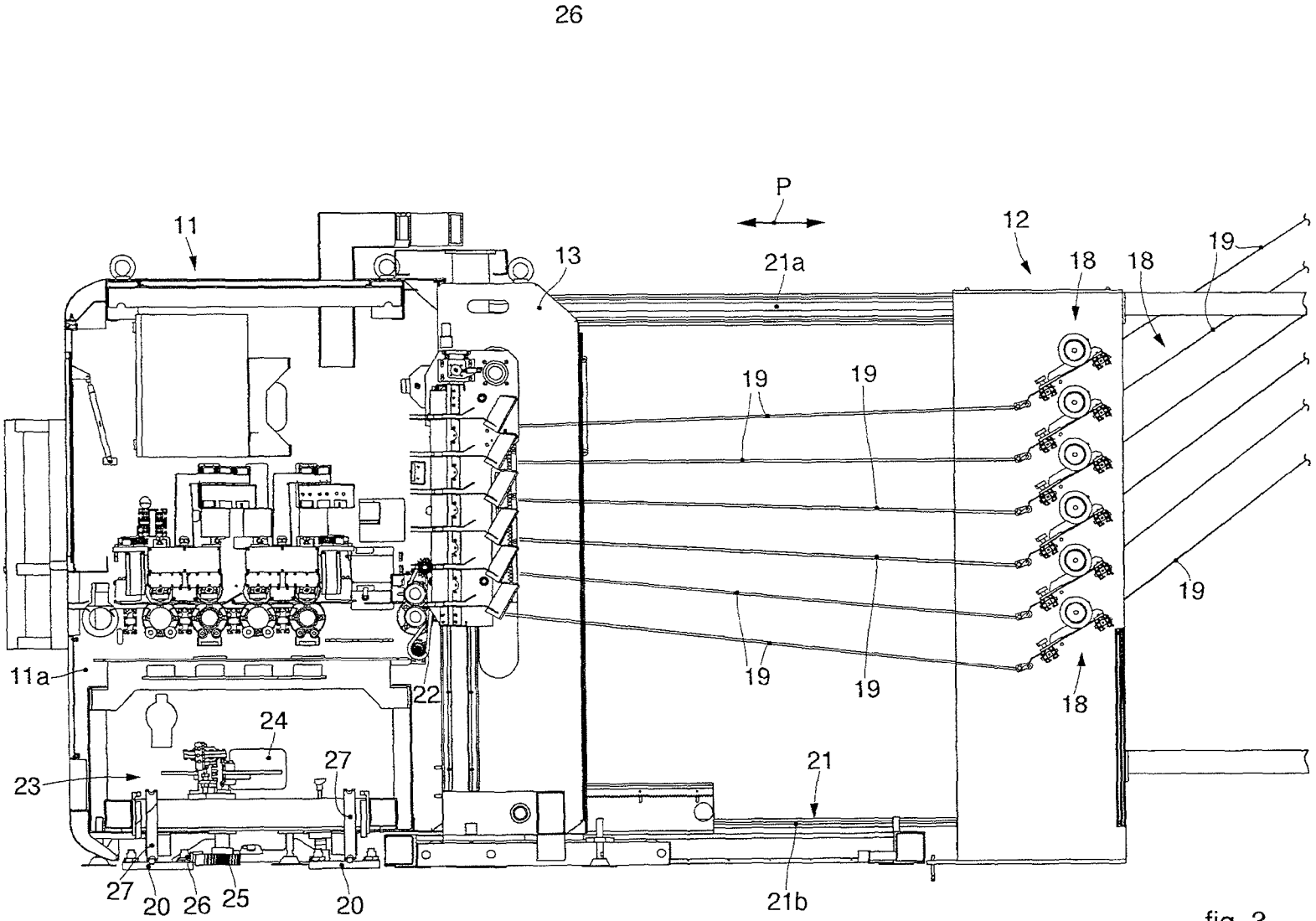
FIGS. 3 and 4 are lateral views in section of the plant according to the section line A-A of FIG. 1.
Figure 4:
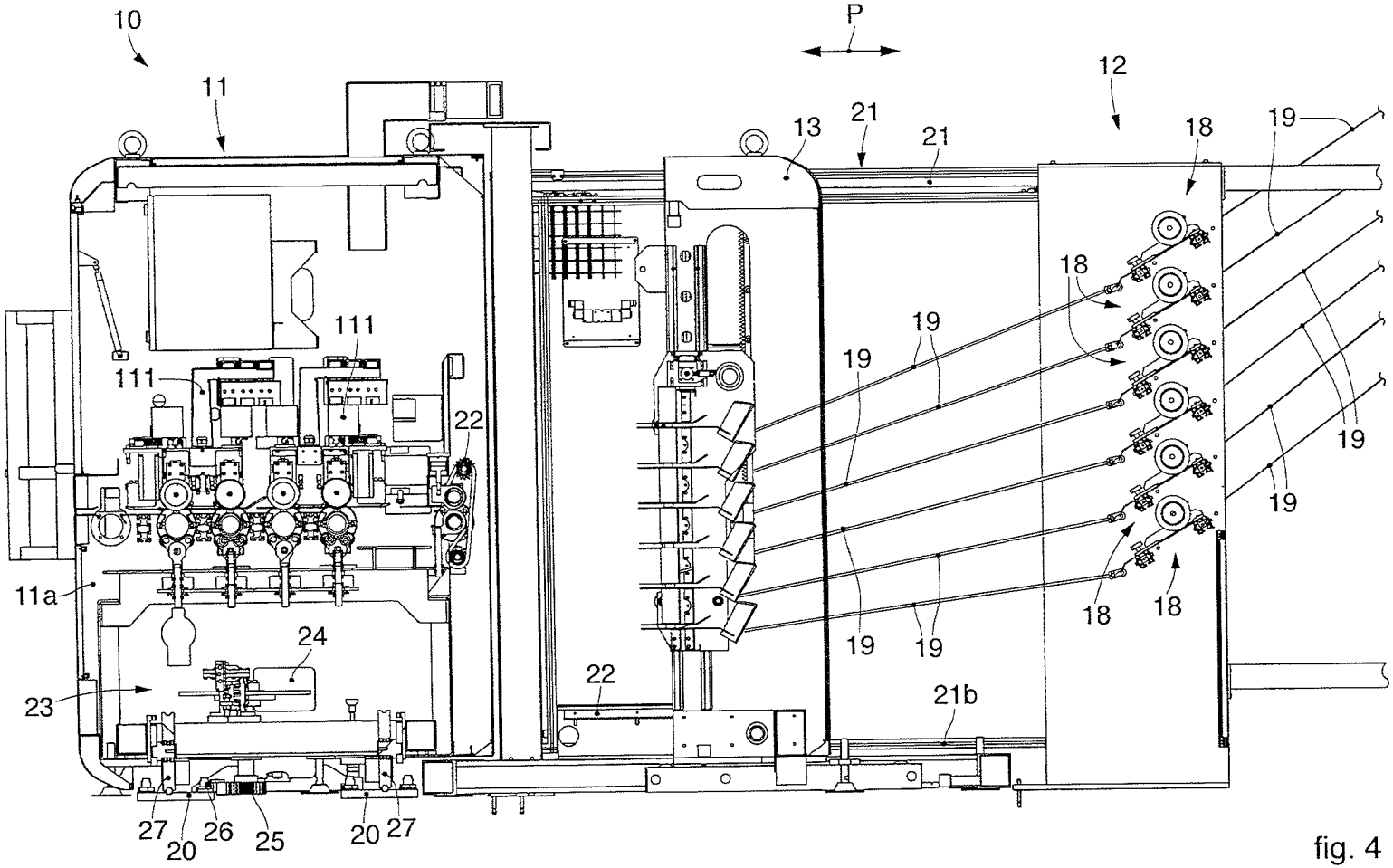

FIGS. 3 and 4 are used to describe possible forms of embodiment of the plant 10 in which the machine 11 comprises a bearing structure 11*a* configured to support and contain one or more work stations 111, each of which is able to carry out a working, for example cutting and/or creasing, on the packaging material.

The machine 11 can also include, in accordance with possible implementations, an introduction device 22, with the function of introducing into the work stations 111 packaging material coming from the automatic feed apparatus 12 or from the manual feeding and loading station 14.

With reference by way of example to FIGS. 3 and 4, the machine 11 can include a movement device 23, connected to the bearing structure 11*a* and cooperating with the transverse guides 20 to move the machine 11 in the direction of movement M.

The movement device 23 can be, for example, the rack type and include a drive member 24 to which a pulley 25 is connected, engaged on a fixed rack 26, parallel to the transverse guides 20. The motion conferred on the pulley 25 by the drive member 24 allows the movement of the bearing structure 11*a,* and consequently of the machine 11, along the fixed rack 26 and therefore along the transverse guides 20 in the direction of movement M.

The sliding of the machine 11 on the transverse guides 20 can be obtained by wheels 27 connected to the bearing structure 11*a.*

Other solutions can provide different types of movement devices 23, for example comprising one or more linear actuators of the screw type, pneumatic, hydraulic, magnetic or sliders or motorized belts or other.

In possible implementations, described with reference by way of example to FIGS. 3 and 4, the longitudinal guides 21 can include upper guides 21*a* and lower guides 21*b,* whose combined presence can for example supply stability to the movement of the selector 13.

This movement, for example, can be supplied to the loading device 13 by a movement device 28, in this case the mechanical rack type. However, different types of movement device 28 cannot be excluded from the scope of the present invention, for example comprising one or more linear actuators of the screw type, pneumatic, hydraulic, magnetic or sliders or belts or other.

Figure 6:
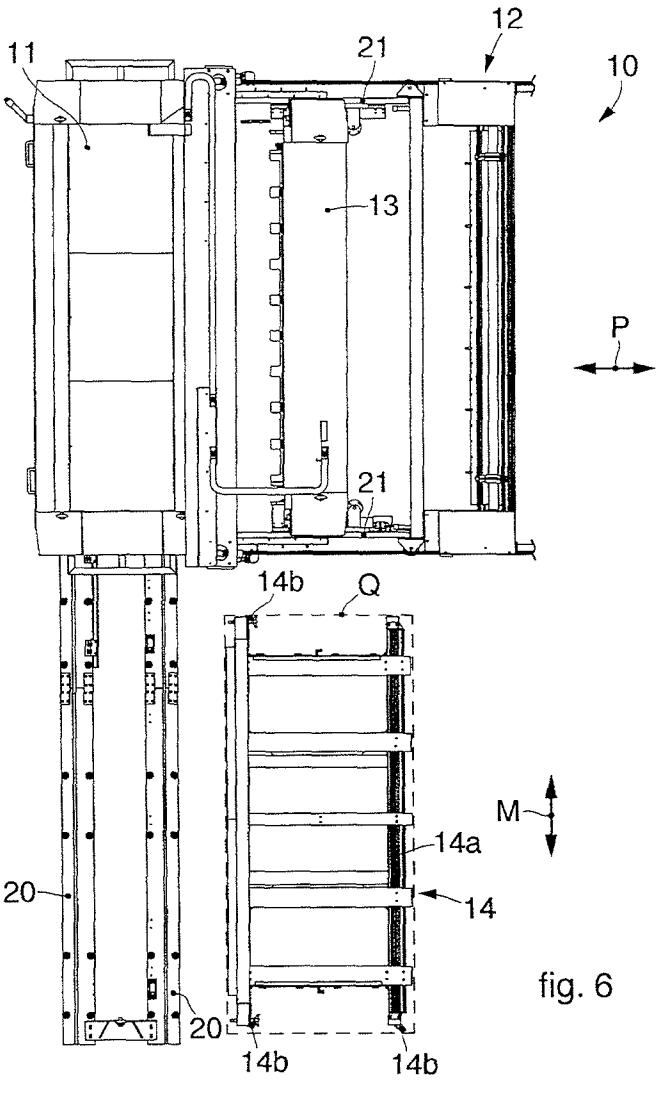
FIGS. 5, 6 and 7 are plan views of a part of the plant in FIG. 1, in different functioning conditions.
Figure 5:
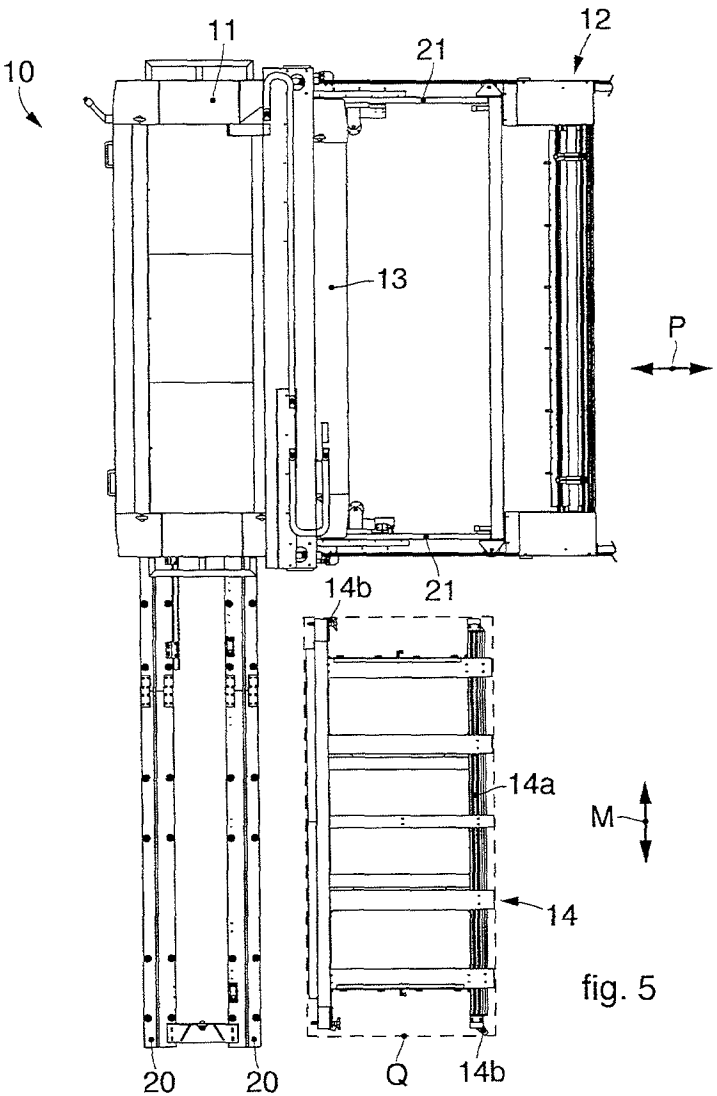
Figure 7:
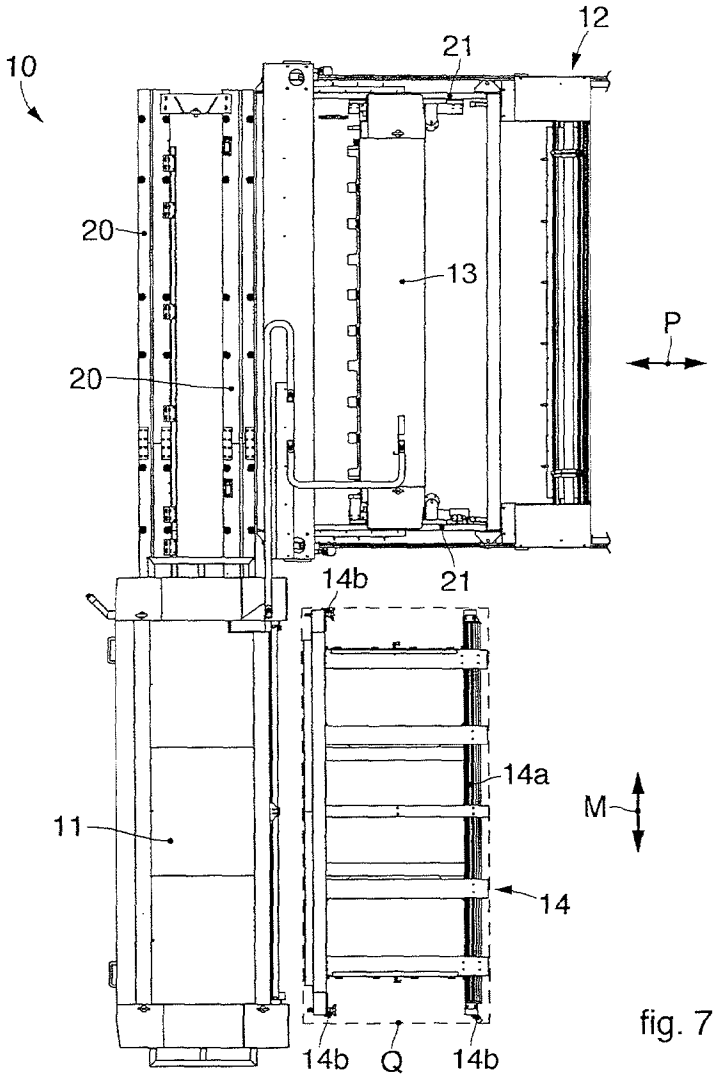

FIGS. 5, 6 and 7 are used to describe by way of example the functioning of the plant 10.

FIG. 5 is used to describe a possible initial condition in which, for example, the machine 11 is in its first position, that is, aligned to the automatic feed apparatus 12, in order to feed the packaging material automatically, and the selector 13 is in its loading condition, partially inside the longitudinal bulk, that is, in the direction of automatic feed P, of the machine 11.

Starting from this initial condition, if it is necessary to pass to a manual feed of the packaging material, the selector 13 is translated along the longitudinal guides 21 in the direction of automatic feed P away from the machine 11, resulting completely outside and unconstrained from it (see FIG. 6 for example).

Then, the machine 11 can be translated along the transverse guides 20 in the direction of movement M and positioned in its second position, aligned to the manual feeding and loading station 14 (see FIG. 7 for example).

The machine 11 can therefore be fed manually, positioning one or more sheets of packaging material on the support plane Q and thrusting the sheets toward the machine 11, so that the introduction device 22 grips the sheets and introduces them to the one or more work stations 111.

In possible implementations, it can be provided to move the manual feeding and loading station 14 in the direction of automatic feed P and nearer to the machine 11, after the positioning of the latter in its second position.

It is clear that modifications and/or additions of parts may be made to the plant 10 as described heretofore, without departing from the field and scope of the present invention.

It is also clear that, although the present invention has been described with reference to some specific examples, a person of skill in the art shall certainly be able to achieve many other equivalent forms of plant 10, having the characteristics as set forth in the claims and hence all coming within the field of protection defined thereby.

The invention claimed is:

1. A plant for making packages, comprising:

at least a machine (11) to work packaging material;

an automatic feed apparatus (12) to feed said packaging material to said machine (11) in a direction of automatic feed (P);

a manual feeding and loading station (14) of the packaging material, adjacent and parallel to said automatic feed apparatus (12), wherein said machine (11) is mobile in a direction of movement (M) transverse to said direction of automatic feed (P) and is selectively positionable in a first position aligned to said automatic feed apparatus (12) and in a second position aligned to said manual feeding and loading station (14); and a guide system to guide said machine (11) between said first position and said second position and vice versa.

2. The plant as in claim 1, further comprising a loading device (13) to load the packaging material, interposed between, and aligned with, said machine (11) and said automatic feed apparatus (12), wherein said loading device (13) is mobile in said direction of automatic feed (P) in order to assume a first loading condition, in which said loading device is connected to said machine (11), and a second non-operative condition, in which said loading device is unconstrained and separate from said machine (11).

3. The plant as in claim 2, wherein said machine (11) comprises a movement device (23) connected to said guide system and moving said machine (11) in a controlled way between said first position and said second position, and vice versa.

4. The plant as in claim 2, further comprising longitudinal guides (21) disposed in said direction of automatic feed (P) and configured to guide said loading device (13) between said first loading condition and said second non-operative condition, and vice versa.

5. The plant as in claim 1, wherein said guide system comprises transverse guides (20) disposed in said direction of movement (M) and guiding said machine (11) between said first position and said second position, and vice versa.

6. The plant as in claim 1, wherein said manual feeding and loading station (14) is mobile at least along said direction of automatic feed (P), moving closer to or distancing from said machine (11).

7. A method of making packages using a plant for making packages, said method comprising: providing providing an automatic feed apparatus (12) that feeds packaging material, in a direction of automatic feed (P) and at least automatically, to a machine (11) working said packaging material, wherein the step of providing an automatic feed apparatus comprises providing an automatic feed apparatus (12) that also feeds said packaging material manually to said machine (11) with a manual feeding and loading station (14) adjacent and parallel to said automatic feed apparatus (12); and moving said machine (11) in a direction of movement (M) transverse to said direction of automatic feed (P) in order to selectively position said machine in a first position aligned to said automatic feed apparatus (12) so as to feed said packaging material automatically, and in a second position aligned to said manual feeding and loading station (14) to feed said packaging material manually.

8. The method as in claim 7, wherein the step of providing an automatic feed apparatus (12) that feeds packaging material automatically comprises disposing a loading device (13) of said packaging material interposed between, and aligned with, said machine (11) and said automatic feed apparatus (12), and connecting said loading device (13) to said machine (11) in a first loading condition, wherein, before moving said machine (11) from said first position to said second position said loading device (13) is moved in said direction of automatic feed (P), with respect to said loading condition, away from said machine (11), in order to make said loading device (13) assume a second non-operative condition, in which said loading device is unconstrained and separated from said machine (11).

9. The method as in claim 7, wherein, after positioning said machine (11) in said second position, said manual feeding and loading station (14) is moved at least in said direction of automatic feed (P) into a vicinity of said machine (11).

* * * * *